US005174511A

United States Patent [19]

Rüegger et al.

[11] Patent Number: 5,174,511

[45] Date of Patent: Dec. 29, 1992

[54] APPARATUS FOR FEEDING MATERIAL FOR A ROLL MILL

[75] Inventors: Edgar Rüegger, Arnegg; Josef Huber, Kreuzlingen; Hugo Hegelbach, Busswil, all of Switzerland

[73] Assignee: Bühler AG, Uzwil, Switzerland

[21] Appl. No.: 678,840

[22] Filed: Apr. 1, 1991

[30] Foreign Application Priority Data

Mar. 31, 1990 [DE] Fed. Rep. of Germany ..... 4010405

[51] Int. Cl.[5] ..... B02C 4/02

[52] U.S. Cl. ..... 241/34; 241/224; 241/226

[58] Field of Search ..... 241/34, 222, 224, 225, 241/226; 222/409

[56] References Cited

U.S. PATENT DOCUMENTS

| | | | |
|---|---|---|---|
| 199,022 | 1/1878 | Boon | 222/409 |
| 1,534,855 | 4/1925 | Lowenthal | 241/224 X |
| 2,620,946 | 12/1952 | Auer | 222/409 X |
| 3,341,137 | 9/1967 | Rettenmaier | 241/222 |
| 3,618,865 | 11/1971 | Grundler et al. | 241/224 X |
| 4,446,992 | 5/1984 | Suzuki et al. | 222/409 X |

FOREIGN PATENT DOCUMENTS

| | | | |
|---|---|---|---|
| 271828 | 12/1987 | European Pat. Off. . | |
| 584164 | 8/1933 | Fed. Rep. of Germany | 241/224 |
| 2032993 | 1/1972 | Fed. Rep. of Germany . | |
| 3631077 | 4/1987 | Fed. Rep. of Germany . | |
| 3303014 | 8/1989 | Fed. Rep. of Germany . | |

*Primary Examiner*—Mark Rosenbaum
*Attorney, Agent, or Firm*—Martin A. Farber

[57] ABSTRACT

Apparatus for feeding particulate material to a roll mill, such as a roll refiner mill, or flaking mill has rollers (1, 2) pressed against each other with the help of a pressure exerting device, and a feeding compartment disposed above the nip (3) for the supply of the material to be ground. The feeding compartment (5) has a supply opening (14), succeeded by a device (11) for supplying mixed material to the rollers (1 and 2). This device is composed of a swivel spout (11) driven backward and forward, substantially lengthwise along the nip (3), by a pivot drive (13).

28 Claims, 3 Drawing Sheets

APPARATUS FOR FEEDING MATERIAL FOR A ROLL MILL

FIELD OF THE INVENTION

The invention relates to an apparatus for feeding material to a roll mill that comprises at least two rollers pressed against each other by a pressure exerting device, the rollers defining a nip, and a feeding compartment that is arranged above the nip for feeding the material to be ground toward the nip, the feeding compartment comprising a supply opening succeeded by a device for feeding the mixed material to the rollers arranged within the feeding compartment.

BACKGROUND OF THE INVENTION

Roll mills such as these are referred to as being of the type where the pair of rollers pressed against each other is driven—by means of a driving unit—with circumferential speeds differing from one another, the pair of rollers either being in the nature of roll refiner mills, or being of a flaking mill type. In these cases, the rollers may have a comparatively slight difference in speed. The German publication DE-A 36 31 077 provides a device of the kind under consideration, and describes a flaking mill in which a mixing device is arranged inside the feeding compartment to compensate for segregation of the material to be ground during transportation. In the case of wet and sticky products liable to agglomeration, the mixing device, which is formed by mixing arms, will rather bring about a segregation of the product than the desired uniform mixing effect of the material to be ground. This occurs even then when such transfer units are used which tend to favor the mixing of the product.

From European patent document DE-PS 33 03 014 a supply unit is known, which, swiveling backward and forward over the length of the rollers of a calendar, feeds the product to be ground immediately into the nip. This supply unit may be suitable for the feeding of separate granulates into the nip. However, for the processing of bulk materials, the provision of a belt conveyor for uniform feeding cannot be recommended, not least because of lacking space inside the feeding compartment.

It is an object of the present invention to design an apparatus for feeding particulate material to a roll mill which can be used for a plurality of bulk materials, particularly for material that is hard to mix, with the apparatus needing little space and being of a simple design as well as preventing unequal roller wear to a high degree.

SUMMARY OF THE INVENTION

In order to attain this object, it is proposed—in accordance with the invention—that the device following the supply opening comprises a swingable tube driven by a swivel drive to a motion backward and forward in the direction of extension of the nip of the rollers.

The material to be ground, or the bulk material, respectively, is supplied into the feeding compartment layer upon layer as this is done in the textile industry by means of cloth folders. Independently of the material to be ground being in a segregated state or having coarser particles, the material to be ground is supplied over the whole length of the feeding compartment in a random fashion.

If the geometrical axis of the swivel spout is arranged at its top portion near the supply opening, the swivel spout performs only a very slight swinging motion within that area of the feeding compartment through which feeding takes place, so that the supply opening can be connected to the swivel spout by means of a bellow unit, or the like. Despite the slightness of the swinging motion in the area of the supply opening, the bottom end of the swivel spout passes over the entire length of the feeding compartment.

The horizontal speed component of the swivel spout corresponds to a sine curve. In case of greater lengths of the feeding compartment, it may be advantageous to provide a pivot drive which is not linear in nature, thus enabling a linearization of the material feed over the entire length of the feeding compartment. Such a pivot drive may be driven by a program controlled electromotive driving unit; it is advantageous, however, to plan the pivot drive in the form of a piston-and-cylinder unit whose driving medium is controlled in dependence upon the swinging motion of the swivel spout. In accordance with the invention, it is also provided to design a simple cam groove control or cam control, respectively, in the form of a mechanical sliding block drive.

It is preferred, if the supply opening is connected to a rotating conveyor driven by a rotative drive, such as a rotary valve or a screw and/or with a pneumatic conveyor, since this kind of conveying is more likely to favor mixing of the material. This is either the case, for example, when using a pneumatic conveyor or with a screw conveyor to which a mixing effect can easily be assigned, if desired, by modifying it to a mixing screw, as is known per se.

In principle, the swivel spout may have a slim cross section offering little resistance to flow within the bulk of material contained within the feeding compartment when swinging within it backward and forward. However, it is preferred to provide at least a level sensor for indicating the filled state at a predetermined level below the swivel spout, the rotating drive being controlled by this level sensor in order to prevent an exceeding of the predetermined level. In order not to have to switch the rotating drive too frequently, a device for providing a switching hysteresis for switching the rotating drive on and off may be employed. Thereby, the level of the material within the feeding compartment may drop by a predetermined amount, as may be detected by a voidance sensor, by way of example. Preferably the device for providing a switching hysteresis is formed by a time function element, particularly an adjustable one, following the above-mentioned level sensor for indicating the filled state within the feeding compartment in the direction of flow of material.

BRIEF DESCRIPTION OF THE DRAWINGS

Other characteristics of the invention will result from the description of embodiments schematically shown in the drawings, in which.

DETAILED DESCRIPTION OF THE DRAWINGS

Figure 1:
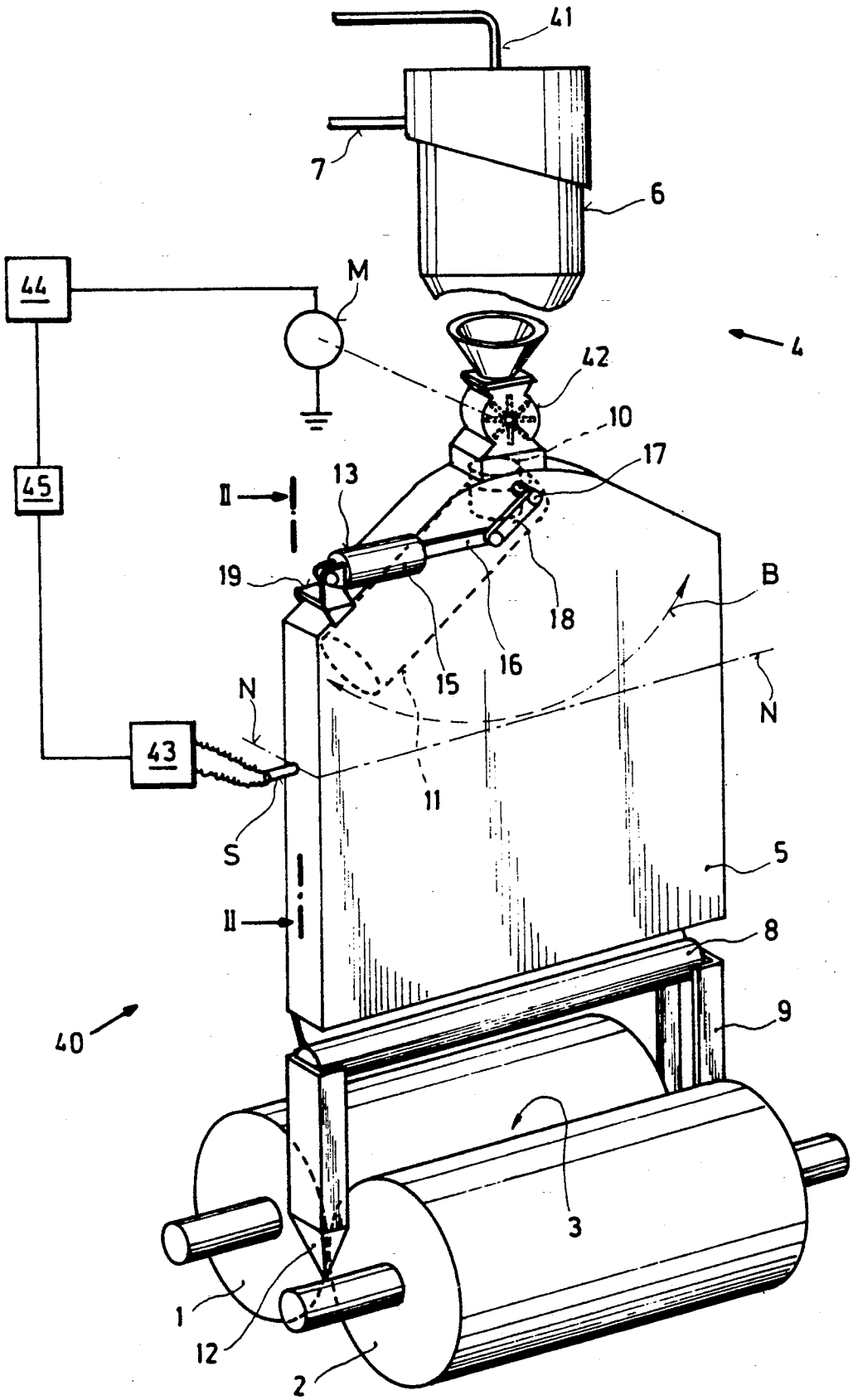
FIG. 1 is a perspective view of an apparatus as provided by the invention for feeding material to a roll mill.

The roll mill shown in FIG. 1 comprises a pair of rollers 1 and 2 of which one roller rotates in a stationary position, and the position of the other roller is movable for pressing the other roller parallely against the first roller. The material to be ground, for example grains or soybeans, gets caught and is crushed in the nip 3 between the two rollers 1 and 2. Above the nip 3, an apparatus for feeding material 40 is provided, and is composed of a feeding compartment 5 connected to a unit 4 delivering the material to be ground.

The unit 4 delivering the material to be ground may be constructed in any form desired, but it is advantageously equipped with a pneumatic conveying unit comprising a conveying pipe 7 which ends in a cyclone 6. The delivery air is drawn off in the usual way from the top end of the cyclone 6 through an air pipe 41. At the bottom end of the cyclone 6, a rotary valve 42 is arranged which can be driven by a motor M. The rotary valve 42 is used to safely seal the cyclone against the feeding compartment 5. On the other hand, it acts as a proportioning device for a proportioned supply into the feeding compartment 5 of material to be ground.

In principle, the rotary valve 42 could be driven with a uniform speed of such a value as to correspond to that of the stream of material being led through the pair of rollers 1 and 2. It is preferred, however, to make the operation of the rotary valve regulable as will be seen from the following description. On the other hand, it is to be understood that the rotary valve may be replaced, with substantially the same advantages, by a screw conveyor (not shown) which would be driven by the motor M.

From the rotary valve 42, the material to be ground drops into a supply opening 14 (FIG. 2) of the feeding compartment 5. The supply opening 14 is formed by a straight tubular piece 10 joined by a swivel spout 11 which is located in the feeding compartment 5. The pivot axis A of the swivel spout 11 is constructed as a rotating shaft unit 17 which is disposed inside the housing of the swivel compartment 5. One end of the rotating shaft unit 17 is linked to a pivoting lever 18 which drives the free end of a piston rod 16 of a piston-and-cylinder unit 15 acting as a pivot drive 13.

The pivot drive 13 makes the swivel spout 11 run backward and forward, with the outlet of the straight-lined swivel spout 11 moving along the path B. The bulk material supplied through the material-delivering unit 4 drops down the supply opening 14 and the straight tubular piece 10 into the swivel spout 11, and is then discharged into the feeding compartment 5 in the form of successive layers, whereby a mixing effect is achieved in a simple way. Thus, the bulk material is kept from forming a cone-shaped layer in the feeding compartment 5, which would give rise to a separation of the coarser, more voluminous particles, from the finer, less voluminous particles. Such separation in turn, would result in a difference in wear of the rollers 1 and 2 over their respective lengths. Furthermore, the segregating effect produced in the course of transport of the bulk material to the feeding compartment 5 is eliminated to a large degree by the arrangement of the swivel spout.

The material to be ground, or the bulk material, respectively, discharged—by the swiveling motion of the swivel spout—over the whole length of nip 3, is supplied to the nip by means of a feeding roller 8. Thereby it is advantageous to design the feeding compartment 5 with a width and the feeding roller 8 with a length greater than the length of rollers 1 and 2. In this way, the curtain of the material which is fed onto these rollers 1 and 2 may drop into channels 9 located at opposite ends of the rollers. Via the channels 9 and their funnel-shaped appendages 12 at their respective bottom ends, the bulk material is fed onto the lateral ends of rollers 1 and 2.

Figure 2:
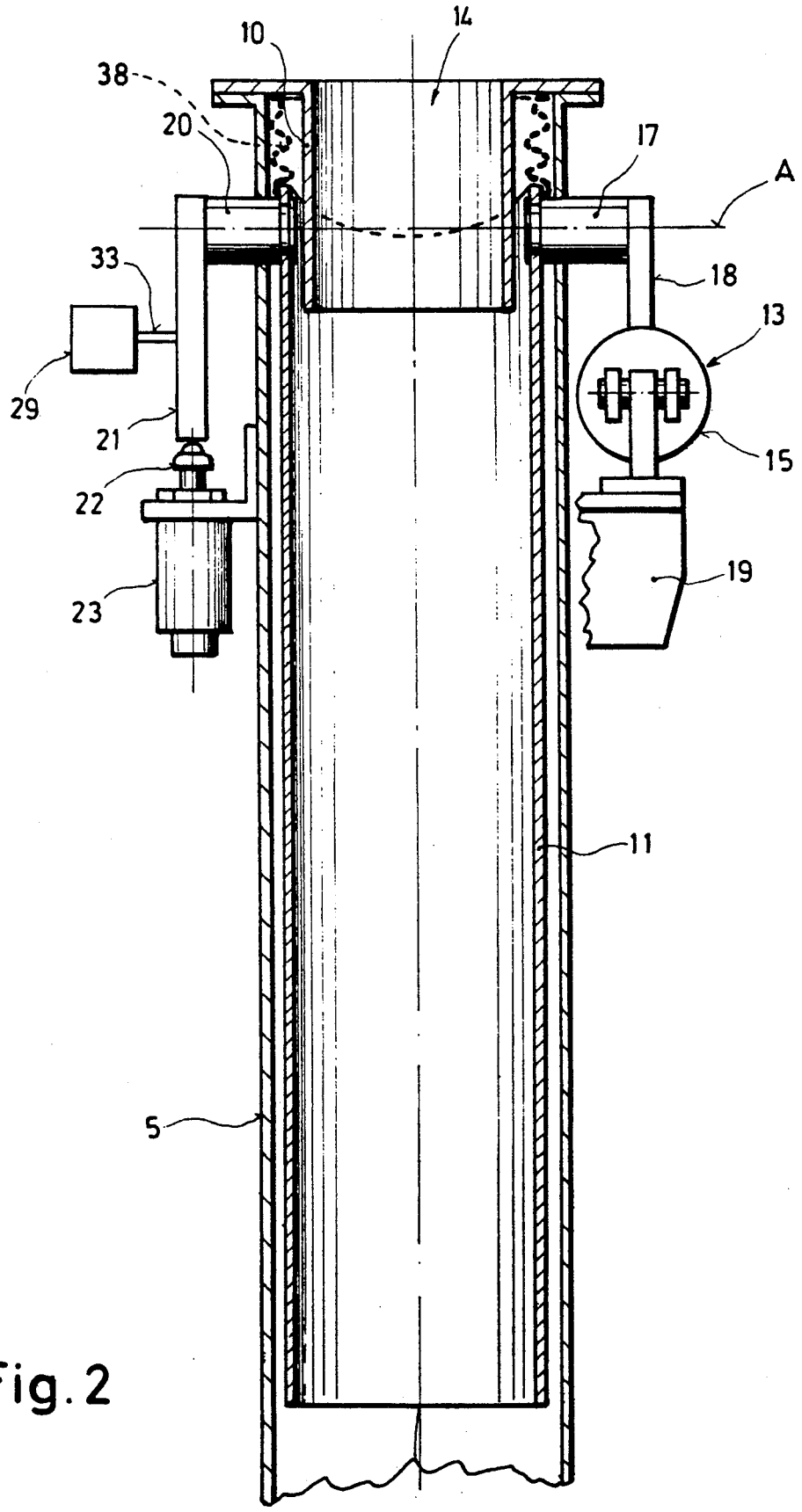
FIG. 2 is a longitudinal view on the line II—II in FIG. 1.

As FIG. 2 has shown in particular, the rotating shaft unit 17 forming the pivot axis A of the swivel spout 11 is located at the upper end of the swivel spout 11 close to supply opening 14. In the embodiment described, the feeding of the bulk material from the supply opening 14 to the swivel spout 11 takes place via a straight tubular piece 10 preferably designed as rigid element, being embedded with its free end in the swivel spout 11. For this purpose, it is preferred to set out the swivel spout 11 with a larger diameter than the straight tubular piece 10. Such an arrangement allows the straight tubular piece 10 to lead into the swivel spout 11 on the level of the rotating shaft unit 17. The swiveling path of the swivel spout 11 is very short in the area of the junction.

If it is not possible, for constructional reasons, to arrange the rotating shaft unit 17 at the upper end of the swivel spout 11, a connection between the discharge opening of the swivel spout 11 and the supply opening 14 can be brought about in a simple way by a bellow unit 38, or the like. Yet it is also possible to design such a bellow unit 38 in such a way as shown in FIG. 2 by broken lines.

The piston-and-cylinder unit 15 planned as pivot drive 13 can be driven with any driving fluid. With such a piston-and-cylinder unit, relatively large regulating distances can be achieved and, if necessary, also with comparatively great forces. In order to compensate for the differential angles resulting from the swinging motion, the cylinder of the pivot drive 13 is designed as swivable element swinging about a perpendicular axis of a base 19 within the swiveling plane of the pivoted lever 18 (FIGS. 1 and 2).

Owing to the predetermined path B of the swivel spout 11, irregularities in the distribution of the bulk material, corresponding to a sine curve, may be produced at the ends of path B in the case of return of motion of the swivel spout 11. With narrow angles of traverse, or a relatively short length of the feeding compartment in longitudinal direction of the nip 3, respectively, or a relatively large length of the swivel spout, respectively, these deviations from linearity may be neglected. However, it is advantageous to linearize the pivot drive. For this purpose, a cam plate 21 is designed at that end of the rotating shaft unit 17 which faces away from the pivoted lever 18. The cam plate 21 cooperates with a cam follower which actuates a pilot valve 23. The shape of the cam plate is designed in such a way that the variations resulting from the swinging motion can be compensated for. For this purpose, the pilot valve arranged in the control circuit of the piston-and-cylinder unit 15 is operated in such a manner that the motion of the swivel spout is somewhat accelerated in its extreme zones, and is slightly decelerated in its medium zones. Thereby, the effect of the pilot valve is such that the cross section of passage of the valve to the piston-and-cylinder unit is enlarged for acceleration of motion, or is diminished for slowing-down of motion, respectively.

Figure 3:
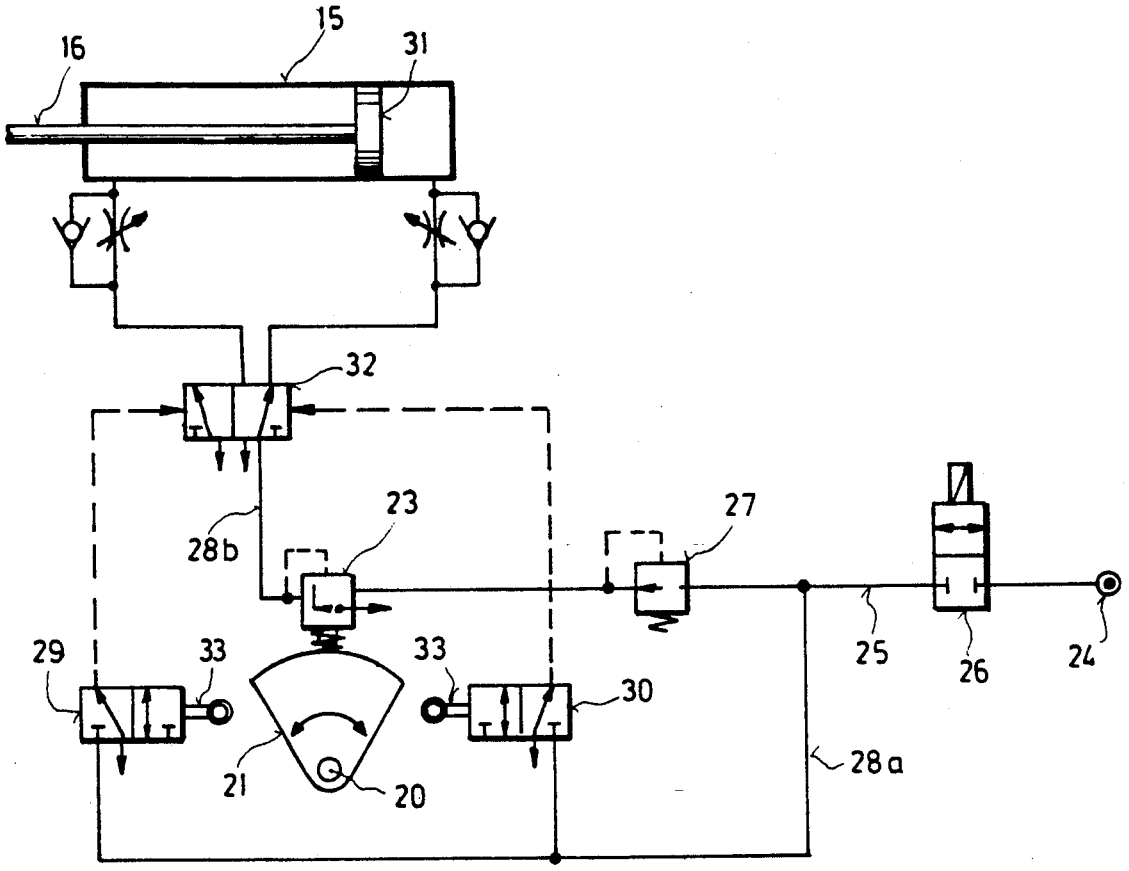
FIG. 3 is a pneumatic circuit diagram for the linear driving unit of a swivel spout of the apparatus for feeding material according to FIG. 1.

The control circuit of the piston-and-cylinder unit 15 is shown in detail in FIG. 3. To simplify the drawing, only the cam plate 21 with the shaft end 20 has been illustrated. The cam plate 21 may be fixed in any rotational position in relation to the shaft 20.

The piston-and-cylinder unit 15 is powered (hydraulically or pneumatically) by a source of pressure 24. In the supply line 25, a relay valve 26 is provided for switching the device on or off. The supply line 25 ramifies into a driving or switching circuit 28*b* and a control circuit 28*a*. A pressure reducing valve, as generally known, comes first in the driving circuit 28*b*. Then, still in the driving circuit, follows the pilot valve 23 whose cross section of passage is adjusted, as previously described, by the cam plate in dependence upon the swiveling position of the swivel spout 11. The piston of the piston-and-cylinder unit 15 may be biased by pressure via a main valve from one side or the other, as generally known. The main valve controls the return of motion and is regulated with the help of pilot valves 29, which, by switching over the main valve 32, initiate the return of motion of the piston rod 16. Thereby, the main valve is advantageously designed as bistable.

The pilot valves 29 and 30 have notches 33 which are actuated in the respective limit positions of the cam plate 21, whereby the main valve 32 is switched over hydraulically or pneumatically into one or other stable switch position. The dynamic behavior of the piston rod 16 between the two change-over points for return of motion is determined solely by the pilot valve 23, or whose cross section of passage, respectively, which is controlled by the shape of the cam plate.

The change-over of the main valve for initiating the return of motion may also take place by electromechanical means. In such a case, the pilot valves 29 and 30 would have to be replaced by corresponding switching devices such as limit switches, or the like.

To create a clearance for the swinging motion of the swivel spout 11 inside the feeding compartment 5, it is preferred to drive the motor M for the turntable drive unit of the rotary valve 42 not in a uniform way, but controlled in dependence upon the filling ratio of the feeding compartment 5. For this purpose, at least one level sensor in the form of a device s for indicating the filled state may be designed on a predetermined level N (FIG. 1), the output signal of which can be conducted to a signal shaping stage 43. The output of this signal shaping stage 43, e.g. a flipflop, is put to a control stage 44 for the motor M.

In this way, care is taken that the level N cannot be exceeded, for the motor M is switched off as soon as the bulk material supplied via the rotary valve 42 reaches the level N. Thus, the motor is immediately switched on again if comparatively little material has gone through the rollers 1 and 2 and the level of material has dropped below a certain level. Therefore, in order not to have to change over too frequently, it is preferred to provide a certain switching hysteresis. This could already be achieved by a certain time lag in the stages 43 and 44. Another possibility is to design a voidance sensor above the bottom of the feeding compartment 5, said voidance sensor switching on again the motor M as soon as such a level is attained which is below level N by a certain predetermined amount. However, it has to be taken into account that such a sensor would come to be situated almost continuously within the area of the material discharged, thus causing considerable abrasion. Consequently, it is more advantageous if a time function element 45 is arranged between the signal shaper 43 and the timing gear 44, the time constant of said time function element being determined in such a way that the level of bulk material cannot exceed a certain predetermined level below level N. The time function element is advantageously designed as an adjustable element, so that it can be adjusted for different kinds of bulk material or qualities, or else for different grinding speeds, respectively. For example, it would be conceivable to provide a common adjusting device for the grinding speed as well as the time function element in order to avoid misadjustments.

Figure 4:
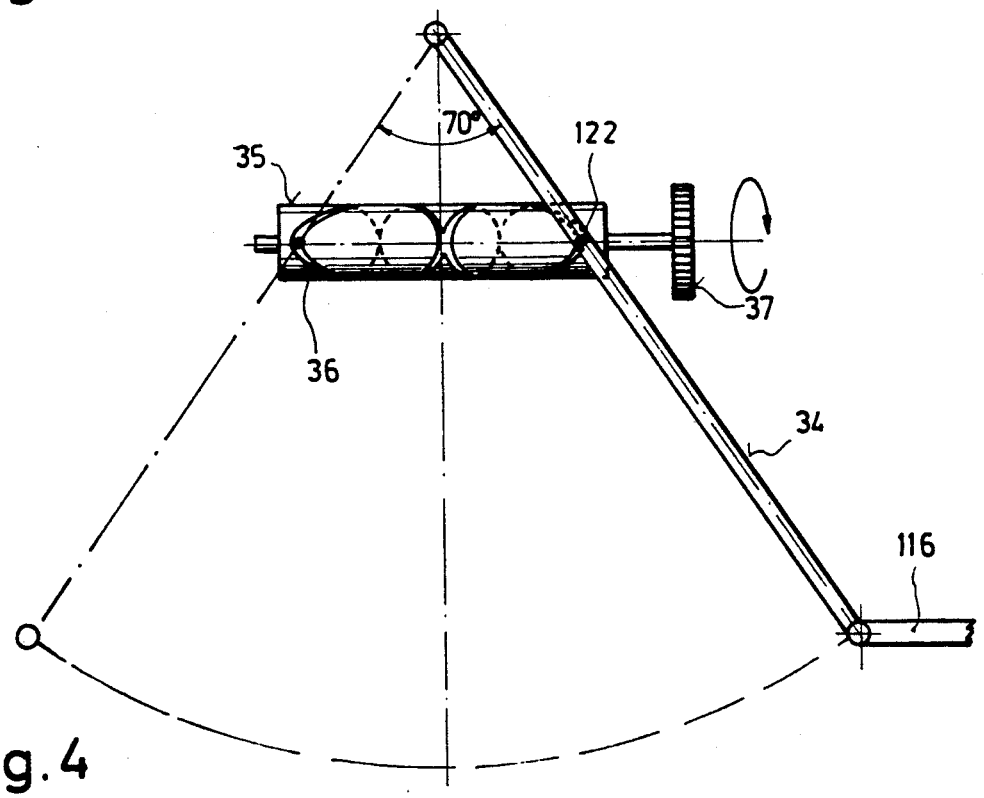
FIG. 4 is a mechanic driving unit for linear guidance of a swivel spout of the apparatus for feeding material according to FIG. 1.

Besides a fluid-driven (hydraulically or pneumatically) pivot drive 13 for the swivel spout 11, a mechanical pivot drive would also be conceivable, as shown, by way of example, in FIG. 4. A lever 34 with a cam follower 122, corresponding to the pivoted lever 18, engages with a guide groove arranged on a drum 35. Such a driving arrangement substantially corresponds to a driving mechanism provided with guide grooves of a thread guide in a quick traverse winder in the textile industry. However, the guide groove 36 depicted in FIG. 4 is of a shape which is different from a screw with a uniform pitch so that the desired linearization of the swinging motion can be achieved. Thus, the pitch is somewhat steeper in the external zones of the drum than it is in its medium zones. If the drum 35 is driven by the drive wheel 37, the motion produced is transmitted directly to the swiveling lever 34 which can drive the rotating shaft unit. Yet it may also be desirable to pivot a rod 116, corresponding to the piston rod 16 in FIG. 1, to the free end of lever 34. In this case, a driving mechanism may also be controlled by means of a pilot valve 23 via the rod 116, as illustrated in FIG. 3. It may also be suitable to design the pivot drive 13 in a simple way as a swinging cam drive. In such a case, however, the cam of such a driving mechanism has to transmit relatively great forces, if arranged near the pivot axis A, while it is to be designed as a comparatively large unit, if arranged at a certain distance from the pivot axis A. Consequently, the arrangement of a pivot drive 13 designed as a piston-and-cylinder unit 15 is preferred.

Since the feeding compartment 5, may be relatively large in width—depending on the respective lengths of roller 1 and 2 —it may be desirable to provide a plurality of sensors, in which case the motor M is switched off in each case where at least one of the level sensors s for indicating the filled state emits the signal "full", or else when at least the majority of the above-mentioned devices emit such a signal.

What is claimed is:

1. Apparatus for feeding particulate material to a roll mill comprising:

at least one pair of rollers pressed toward each other to form a nip;

wall means forming a feeding compartment having a top portion and a bottom portion located above said pair of rollers;

transfer means for transferring particulate material from said bottom portion toward said rollers; and supply means for supplying said particulate material into said compartment; and wherein said supply means includes:

a supply opening at said top portion;

mixed particle supply means which comprises swingable tube means movably supported within said compartment and extending in a substantially vertical direction so as to have a top end and a bottom end;

pivotal support means on said tube means defining a pivot axis for allowing a swinging motion in a plane parallel to said nip, and swivel drive means to impart swinging motion to said tube means.

2. Apparatus as claimed in claim 1, wherein said swingable tube means is directly connected to said supply opening.

3. Apparatus as claimed in claim 1, wherein said pivot axis is located at said top end of said tube means.

4. Apparatus as claimed in claim 1, wherein: said pivot axis is located at said supply opening.

5. Apparatus as claimed in claim 1, wherein said nip is arranged within a predetermined vertical plane, said pivot axis extending normally to said vertical plane.

6. Apparatus as claimed in claim 1, wherein said tube means comprises a straight tubular piece.

7. Apparatus as claimed in claim 6, wherein said tubular piece is cylindrical.

8. Apparatus as claimed in claim 1, further comprising stationary tube means interconnecting said supply opening and said swingable tube means.

9. Apparatus as claimed in claim 8, wherein said stationary tube means and said swingable tube means interengage each other.

10. Apparatus as claimed in claim 9, wherein said stationary tube means is of smaller dimension than said swingable tube means and has an end within said swingable tube means.

11. Apparatus as claimed in claim 1, further comprising bellow means interconnecting said supply opening and said swingable tube means.

12. Apparatus as claimed in claim 1, wherein said pivotal supporting means comprises rotating shaft means fixed to said swingable tube means, said swivel drive means being connected to said shaft means.

13. Apparatus as claimed in claim 1, wherein said swivel drive means comprises a piston-and-cylinder-unit having a piston rod, said shaft means comprising a shaft and swivel lever means fixed on the shaft, said swivel lever being connected to said piston rod.

14. Apparatus as claimed in claim 1, wherein a path of swing of said tube is coplanar with said nip; and said swivel drive means comprises linearizing means for linearizing a motion of said swivel tube means as viewed via a projection of said swinging motion onto said nip.

15. Apparatus as claimed in claim 14, wherein said swivel drive means comprises a piston-and-cylinder-unit having a piston rod, said linearizing means comprising valve means for controlling a fluid flow for said piston-and-cylinder-unit, the apparatus further comprising flow control means for controlling said valve means in dependency upon the respective position of said swivel tube means.

16. Apparatus as claimed in claim 15, wherein said flow control means comprises cam means.

17. Apparatus as claimed in claim 16, wherein said cam means is disposed on said pivotal support means for movement therewith.

18. Apparatus as claimed in claim 1, wherein said transfer means comprises at least one feeding roller of a predetermined length, said nip being of a smaller length than said predetermined length.

19. Apparatus as claimed in claim 18, wherein said compartment has also said predetermined length, said swinging motion of said swivel tube means being of sufficient length to distribute said particles over the whole predetermined length.

20. Apparatus as claimed in claim 1, wherein said supply means comprises a rotating conveyor and rotation imparting means for it.

21. Apparatus as claimed in claim 20, wherein said rotating conveyor is of the rotating valve type.

22. Apparatus as claimed in claim 1, wherein said supply means comprises a pneumatic conveyor.

23. Apparatus as claimed in claim 1, further comprising level sensor means for sensing the level of particulate material within said compartment and for controlling said supply means to shut off the supply of particulate material, when said level attains a predetermined height below said swivel tube means.

24. Apparatus as claimed in claim 23, wherein said supply means comprises a rotating conveyor and rotation imparting means for it, said level sensor means controlling rotation of said rotation imparting means.

25. Apparatus as claimed in claim 23, further comprising means providing a switching hysteresis to allow said level to fall a certain amount below said predetermined height.

26. Apparatus as claimed in claim 25, wherein said means providing a switching hysteresis comprises a timing member lying in series to said level sensor means.

27. Apparatus as claimed in claim 26, wherein said timing member is adjustable.

Please add the following claim:

28. Apparatus for feeding particulate material to a roll mill comprising:

at least one pair of rollers pressed toward each other to form a nip;

wall means forming a feeding compartment having a top portion and a bottom portion located above said pair of rollers;

supply means for supplying said particulate material into said compartment; and wherein said supply means includes:

a supply opening at said top portion;

mixed particles supply means which comprise swingable tube means movably supported within said compartment and extending in a substantially vertical direction so as to have a top end and a bottom end;

pivotal support means on said tube means defining a pivot axis for allowing a swinging motion in a plane parallel to said nip, the bottom end of the tube means moving above the nip during said swinging motion to distribute the particulate material; and swivel drive means to impart swinging motion to said tube means.

* * * * *